US007520010B2

(12) United States Patent
Welch

(10) Patent No.: US 7,520,010 B2
(45) Date of Patent: Apr. 21, 2009

(54) FOLDABLE CIRCULAR BABY CHANGING PAD HAVING ANNULAR STORAGE AREA AND PERIMETER HANDLES WITH ENDS AT FOLD LINES

(75) Inventor: Grace M. Welch, San Francisco, CA (US)

(73) Assignee: Patemm Inc., San Francisco, CA (US)

( * ) Notice: Subject to any disclaimer, the term of this patent is extended or adjusted under 35 U.S.C. 154(b) by 0 days.

(21) Appl. No.: 11/398,798

(22) Filed: Apr. 6, 2006

(65) Prior Publication Data

US 2006/0191074 A1 Aug. 31, 2006

Related U.S. Application Data

(63) Continuation of application No. 10/872,801, filed on Jun. 21, 2004, now abandoned.

(51) Int. Cl.

| | |
|---|---|
| ***A47G 9/06*** | (2006.01) |
| ***A45C 9/00*** | (2006.01) |
| ***B65D 30/10*** | (2006.01) |
| ***A45F 4/02*** | (2006.01) |
| *B68G 5/02* | (2006.01) |

(52) U.S. Cl. ..... 5/655; 5/420; 190/1; 383/4; 224/577

(58) Field of Classification Search ..... 5/655, 5/417, 420; D6/392, 503; 190/1; 383/4; 224/577

See application file for complete search history.

(56) References Cited

U.S. PATENT DOCUMENTS

| | | | | | |
|---|---|---|---|---|---|
| 655,308 | A | * | 8/1900 | Robinson | 160/230 |
| 970,861 | A | * | 9/1910 | Veach | 160/231.1 |
| 997,129 | A | * | 7/1911 | Reynolds | 100/219 |
| RE15,708 | E | * | 10/1923 | Laidman | 160/230 |
| 1,629,723 | A | * | 5/1927 | Moler | 604/262 |
| 1,683,678 | A | * | 9/1928 | Kitterman et al. | 383/22 |
| 2,288,469 | A | * | 6/1942 | Lookholder | 160/405 |
| 2,442,105 | A | * | 5/1948 | Vacheron | 2/69.5 |
| 2,479,203 | A | * | 8/1949 | Brown | 383/4 |
| 2,731,997 | A | * | 1/1956 | Muth et al. | 383/4 |
| 2,738,834 | A | * | 3/1956 | Jaffe et al. | 5/420 |
| 2,803,845 | A | * | 8/1957 | Paschall | 15/209.1 |

(Continued)

OTHER PUBLICATIONS

One Step Ahead Catalog, early Spring 2002, p. 47, Diaper Changing Pads. www.onestepahead.com.

*Primary Examiner*—Gay Ann Spahn
(74) *Attorney, Agent, or Firm*—Fliesler Meyer LLP

(57) ABSTRACT

A diaper changing article comprising a flat circular body preferably having a plurality of fold lines therein, wherein the body is adapted to be folded about the fold lines to open and close the changing article; preferably, a storage area radially arranged about a center of the circular body, wherein at least one pocket in the storage area has an opening proximal to the center of the circular body; and at least one handle coupled to the outer edge, wherein a handle is adapted to carry the body is exposed in the closed position and a second handle is adapted to maintain the body in the closed position. In one embodiment, the article has at least one pocket which has an opening that is proximal to the outer edge of the circular body. The diaper changing article preferably has a polygonal shape, such as a square, when folded closed.

9 Claims, 5 Drawing Sheets

U.S. PATENT DOCUMENTS

| | | | | | |
|---|---|---|---|---|---|
| 3,073,367 | A | | 1/1963 | Samara | 150/2.1 |
| 3,143,748 | A | | 8/1964 | Manning | 5/344 |
| 3,477,552 | A | * | 11/1969 | Goldman | 190/2 |
| 3,489,194 | A | | 1/1970 | Hoover | 150/1 |
| D230,117 | S | | 1/1974 | Johnson | D6/201 |
| 4,123,809 | A | * | 11/1978 | Pugh | 4/659 |
| 4,337,812 | A | * | 7/1982 | Trinkner | 383/4 |
| 4,375,111 | A | * | 3/1983 | Hall | 5/419 |
| 4,466,516 | A | * | 8/1984 | Sicoli et al. | 190/2 |
| 4,468,810 | A | * | 8/1984 | Longo | 383/3 |
| 4,566,130 | A | | 1/1986 | Coates | 383/15 |
| 4,658,452 | A | * | 4/1987 | Brockhaus | 5/420 |
| 4,671,393 | A | * | 6/1987 | Rainey | 190/1 |
| D290,908 | S | | 7/1987 | Thomas | D3/71 |
| D291,133 | S | * | 7/1987 | Disanza | D34/1 |
| D293,060 | S | * | 12/1987 | Botbol | D6/608 |
| 4,723,327 | A | * | 2/1988 | Smith | 5/89.1 |
| D294,909 | S | | 3/1988 | Donnor | D6/595 |
| 4,781,277 | A | | 11/1988 | Lim | 190/1 |
| 4,788,726 | A | | 12/1988 | Rafalko | 5/93 |
| 4,792,024 | A | | 12/1988 | Morton | 190/1 |
| 4,794,029 | A | | 12/1988 | Tennant | 428/101 |
| D299,979 | S | * | 2/1989 | Garrison | D34/1 |
| 4,856,912 | A | | 8/1989 | Damus | 383/4 |
| 4,863,003 | A | * | 9/1989 | Carter | 190/8 |
| 4,886,150 | A | | 12/1989 | Fitzsimmons | 190/1 |
| 4,949,415 | A | * | 8/1990 | Selga | 5/502 |
| 4,952,073 | A | * | 8/1990 | Wieland | 383/4 |
| 4,955,068 | A | * | 9/1990 | Tennihan | 383/4 |
| 4,961,522 | A | * | 10/1990 | Weber | 224/585 |
| 4,964,859 | A | * | 10/1990 | Feldman | 604/385.06 |
| 4,991,978 | A | * | 2/1991 | Ostrowski | 383/4 |
| 5,010,610 | A | * | 4/1991 | Ackley | 5/691 |
| 5,035,013 | A | | 7/1991 | Bloom | 5/420 |
| 5,044,031 | A | * | 9/1991 | Sherwood et al. | 2/69.5 |
| 5,048,975 | A | * | 9/1991 | Holbrook | 383/4 |
| 5,059,463 | A | * | 10/1991 | Peters | 428/64.1 |
| 5,069,554 | A | | 12/1991 | Bonnett | 383/4 |
| 5,088,139 | A | | 2/1992 | Bloom | 5/420 |
| 5,092,681 | A | * | 3/1992 | Ashley, III | 383/4 |
| D330,139 | S | | 10/1992 | Bloom | D6/596 |
| 5,172,440 | A | * | 12/1992 | Ming | 5/485 |
| 5,187,823 | A | * | 2/1993 | Ferguson et al. | 5/417 |
| 5,203,041 | A | * | 4/1993 | Alonso | 5/420 |
| 5,210,891 | A | * | 5/1993 | Avital et al. | 5/420 |
| D339,710 | S | | 9/1993 | Perna, Jr. | D6/608 |
| 5,346,308 | A | * | 9/1994 | Buhot et al. | 383/4 |
| 5,370,460 | A | * | 12/1994 | Nelson | 383/4 |
| D355,096 | S | | 2/1995 | Lang | D6/608 |
| 5,386,603 | A | * | 2/1995 | Drust | 5/417 |
| 5,414,881 | A | * | 5/1995 | Terrazas | 5/417 |
| 5,419,564 | A | * | 5/1995 | Lamle | 273/264 |
| 5,429,541 | A | * | 7/1995 | Landon | 446/70 |
| D366,368 | S | | 1/1996 | McCarthy | D6/333 |
| 5,481,768 | A | * | 1/1996 | Shink | 5/482 |
| 5,482,374 | A | * | 1/1996 | Buhyoff | 383/4 |
| 5,533,653 | A | * | 7/1996 | Kaufman | 224/577 |
| 5,666,679 | A | | 9/1997 | Ruddy | 5/502 |
| 5,692,257 | A | * | 12/1997 | Albertieri | 5/655 |
| 5,743,649 | A | * | 4/1998 | Gonzalez | 383/6 |
| 5,819,343 | A | * | 10/1998 | Zampirri, Jr. et al. | 5/417 |
| D407,216 | S | | 3/1999 | Vickers | D3/233 |
| 5,887,301 | A | * | 3/1999 | Anderson | 5/482 |
| 5,895,118 | A | * | 4/1999 | Hensley | 383/3 |
| D410,144 | S | | 5/1999 | Kay | D3/233 |
| 5,971,611 | A | | 10/1999 | Rosengren | 383/4 |
| D417,090 | S | | 11/1999 | Reynolds | D6/390 |
| 5,978,989 | A | * | 11/1999 | Chavez | 5/627 |
| D421,178 | S | | 2/2000 | Dandini | D3/233 |
| 6,094,759 | A | * | 8/2000 | Thompson | 5/420 |
| 6,105,188 | A | * | 8/2000 | Perez-Mesa et al. | 5/655 |
| 6,176,356 | B1 | | 1/2001 | Powley | 190/1 |
| 6,185,765 | B1 | * | 2/2001 | High | 5/419 |
| 6,212,711 | B1 | | 4/2001 | Gilmour | 5/420 |
| 6,269,502 | B1 | * | 8/2001 | Exstrom | 5/655 |
| 6,272,704 | B1 | | 8/2001 | Cutler | 5/655 |
| 6,327,726 | B1 | * | 12/2001 | Weber | 5/655 |
| 6,370,715 | B1 | * | 4/2002 | Morton | 5/655 |
| 6,389,624 | B1 | * | 5/2002 | Madole | 5/655 |
| 6,390,260 | B1 | * | 5/2002 | Roegner | 190/109 |
| 6,393,638 | B1 | * | 5/2002 | MacColl | 5/419 |
| 6,408,462 | B1 | * | 6/2002 | Moore | 5/417 |
| 6,427,271 | B1 | * | 8/2002 | Gadzia et al. | 5/627 |
| 6,443,794 | B2 | * | 9/2002 | Oren et al. | 446/85 |
| D467,117 | S | | 12/2002 | Guy | D6/596 |
| 6,523,989 | B2 | * | 2/2003 | Carty | 366/129 |
| 6,640,359 | B1 | * | 11/2003 | Alane | 5/420 |
| 6,684,422 | B2 | * | 2/2004 | LeFevre et al. | 5/496 |
| 6,691,356 | B1 | * | 2/2004 | Coma | 5/722 |
| 6,694,552 | B1 | | 2/2004 | Vickers | 5/655 |
| D493,657 | S | * | 8/2004 | Farago et al. | D6/608 |
| 6,901,615 | B1 | * | 6/2005 | Lombardo et al. | 5/417 |
| D508,181 | S | * | 8/2005 | Welch | D6/596 |
| 7,018,267 | B2 | * | 3/2006 | Delaney et al. | 446/487 |
| 2003/0190096 | A1 | * | 10/2003 | Miodragovic et al. | 383/4 |
| 2003/0196266 | A1 | * | 10/2003 | Zheng | 5/417 |
| 2004/0163179 | A1 | * | 8/2004 | Trefethren et al. | 5/655 |
| 2005/0005361 | A1 | * | 1/2005 | Conforti | 5/655 |
| 2005/0028277 | A1 | * | 2/2005 | Gordon et al. | 5/420 |
| 2005/0039260 | A1 | * | 2/2005 | Tyler | 5/417 |
| 2005/0039261 | A1 | * | 2/2005 | Corral | 5/417 |
| 2005/0071920 | A1 | * | 4/2005 | Higashi et al. | 5/417 |
| 2005/0081297 | A1 | * | 4/2005 | Woodward et al. | 5/655 |
| 2006/0026758 | A1 | * | 2/2006 | Corral | 5/420 |
| 2006/0037139 | A1 | * | 2/2006 | Akkad | 5/419 |
| 2006/0215939 | A1 | * | 9/2006 | Watkins | 383/4 |
| 2007/0087657 | A1 | * | 4/2007 | Campbell et al. | 446/482 |
| 2007/0122066 | A1 | * | 5/2007 | Landay | 383/16 |
| 2007/0127849 | A1 | * | 6/2007 | Lakis | 383/4 |

* cited by examiner

FOLDABLE CIRCULAR BABY CHANGING PAD HAVING ANNULAR STORAGE AREA AND PERIMETER HANDLES WITH ENDS AT FOLD LINES

CLAIM OF PRIORITY

The present application is a continuation of U.S. patent application Ser. No. 10/872,801, filed Jun. 21, 2004, entitled "Diaper Changing Article", now abandoned, which is hereby incorporated herein by reference.

FIELD OF THE INVENTION

The present invention relates generally to a diaper changing article.

BACKGROUND OF THE INVENTION

Diaper changing pads as well as diaper changing stations are widely used to change a child's diaper on the go. However, conventional diaper changing pads are rectangular in shape and are cumbersome for the parent. The conventional changing pads are disadvantageous, because the rectangular shape of the pad requires the child to be aligned on the pad properly to ensure complete coverage from the supporting surface. This may be quite difficult if the child does not lay still or likes to roll over while being changed.

What is needed is a diaper-changing article which is convenient for the parent to change the child's diaper.

DETAILED DESCRIPTION OF THE PRESENT INVENTION

One aspect of the invention is directed to a diaper changing article which comprises a flat body that has a circular outer edge and a plurality of fold lines therein, wherein the body is adapted to be folded about the fold lines to selectively open and close the changing article. The article, when folded, is substantially flat so that the folded article is able to be easily stored in a small enclosed space (e.g. purse, diaper bag).

In another aspect of the invention, a diaper changing article which comprises a flat body which has a circular outer edge and a plurality of fold lines therein, wherein the body is adapted to be folded about the fold lines to selectively open and close the changing article between an open and closed position. The changing article comprises a plurality of handles coupled to the outer edge, wherein a first handle is adapted to carry the body in the closed position. Also, a second handle is adapted to maintain the body in the closed position.

In another aspect of the present invention, a diaper changing article which comprises a flat circular body which has a plurality of fold lines therein, wherein the body is adapted to be folded about the fold lines to open and close the changing article. The diaper changing article also includes a storage area which is radially arranged about a center of the circular body, wherein at least one pocket in the storage area has an opening proximal to the center of the circular body.

In yet another aspect of the present invention, a diaper changing article which comprises a flat body that has a circular outer edge and a plurality of fold lines therein, wherein the body is adapted to be folded about the fold lines to selectively open and close the changing article between an open and closed position. The article also comprises a plurality of handles which are coupled to the outer edge, wherein at least one handle, adapted to carry the body, is exposed in the closed position.

In at least one of the above embodiments, the article has at least one pocket which has an opening that is proximal to the outer edge of the circular body. The diaper changing article has a polygonal shape, such as a square, when folded in the closed position. The handle, which is attached to the outer edge of the flat body, is preferably a loop that is adapted to traverse from first side to an opposite second side of the polygonal shape to maintain the folded body in the closed position.

Figure 1:
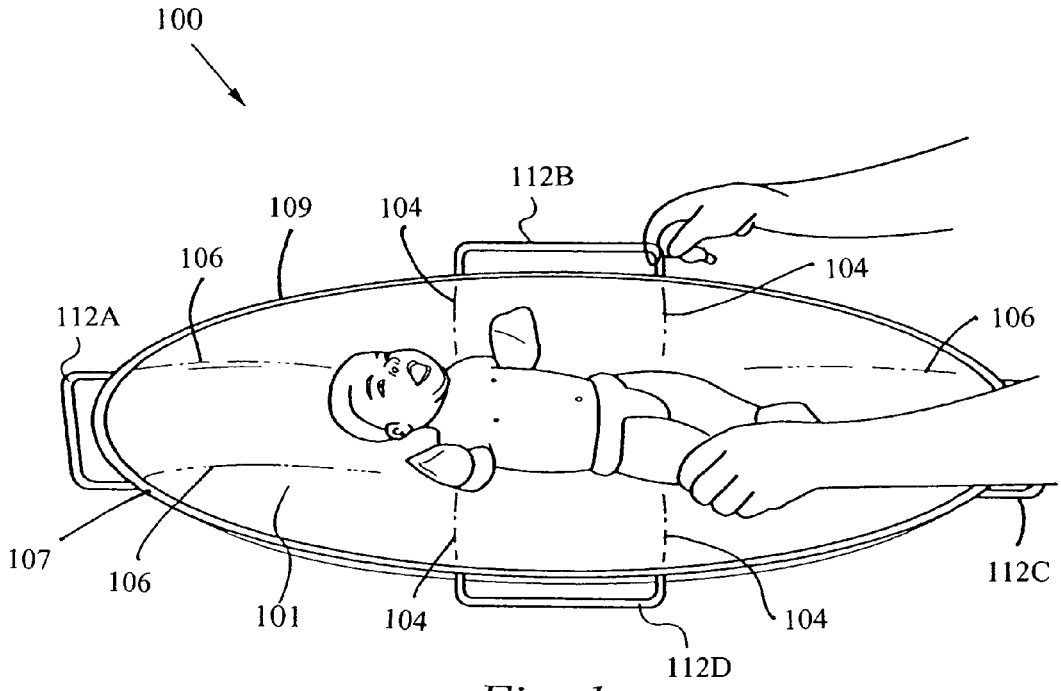
FIG. 1 illustrates a perspective view of one embodiment of the baby changing article in accordance with the present invention.

FIG. 1 illustrates a perspective view of one embodiment of the baby changing article in accordance with the present invention. The baby changing article 100 is preferably utilized to change the child's (e.g. infant) diaper. As shown in FIG. 1, the baby changing article 100 has a circular or substantially circular body 101. For instance, the changing article 100 can have several (e.g. twenty) discrete sides on its outer edge, but still have an overall substantially circular body 101. Existing changing pads are rectangular in shape which feature requires the parent or user to align the child precisely onto the rectangular changing pad to change the child's diaper. Once the child is placed on the rectangular changing pad, the child may not lie still and may begin to roll, flip or move onto the area surrounding the article 100. It is, of course, an annoyance for the parent to try to align and place the child on the rectangular changing pad. It is a further annoyance for the parent to keep the child from moving onto the area (e.g. bathroom floor, grass) surrounding the rectangular changing pad. The circular changing article 100 of the present invention allows the parent to change the child's diaper without these types of worries and annoyances. In particular, the parent can lay down the child onto the article 100 without needing to orient the child in any specific direction due to the circular shape of the article 100. In addition, the circular shape of the changing article 100 provides ample room such that the child does not come into contact with the surrounding area.

In one embodiment, the changing article 100 can be padded to provide a cushion for the child while lying on the changing article 100. The changing article preferably has four handles 112A-112D attached to the outer edge of the body 101. Alternatively, the article 100 has any number of handles 112. In another embodiment, the changing article 100 does not include handles 112. The handles 112A-112D are preferably located 90 degrees from each other with respect to the center of the body 101.In another embodiment, the handles 112A-112D are located at any other angle from each other with respect to the center of the body 101. The handles 112A-112D are preferably attached to the body 101 at the locations where the fold lines 104, 106 meet the outer edge of the body 101. The handles 112A-112D are positioned such that at least one handle 112 is exposed (FIG. 10) when the article 100 is folded, irrespective of the order in which the article 100 is folded. In addition, the handles 112A-112D are advantageously located, such that the article 100 can be opened or closed in any order with only one hand. The exposed handle 112 allows the user to carry the article 100. The handles 112A-112D are also formed to be a loop that is long enough to secure the folded body 101 in a closed position, as will be discussed below.

The changing article 100 preferably includes several fold lines 104, 106 in the body 101 which allow the changing article 100 to be easily folded for storage. In particular, the article 100 is foldable about the fold lines 104, 106 in any order such that the parent is able to fold the article with one hand. The ability of the changing article 100 to be easily folded is advantageous to the parent, especially if the parent is holding the child with his or her other hand. In addition, the article 100, when folded, is substantially flat so that the folded article 100 is able to be easily placed in a small enclosed space (e.g. purse, diaper bag). Referring to F*igure* 3, the changing article 100 preferably has two spaced-apart fold lines 104 as well as another two spaced-apart fold lines 106 oriented perpendicularly to the fold lines 104. The fold lines 104 and 106 are spaced apart an equal distance to intersect in the center of the changing article, thereby creating a neat, compact, polygonal shaped center area 108 (e.g. a square). The polygonal shaped center area 108 forms the polygonal folded article 100 when the article 100 is folded in the closed position. It should be noted that any other shape is contemplated for the center area 108 and is not limited to a square shape. The compact, folded article 100, when folded, allows the article 100 to be easily placed in the small enclosed space. In one embodiment, the fold lines 104, 106 are formed in the changing article body 101 by sew lines stitched into the body 101. In another embodiment, the fold lines 104, 106 are formed in the body 101 by any other method or means. In yet another embodiment, no sew lines are formed into the body 101 at the fold lines 104, 106.

Figure 2:
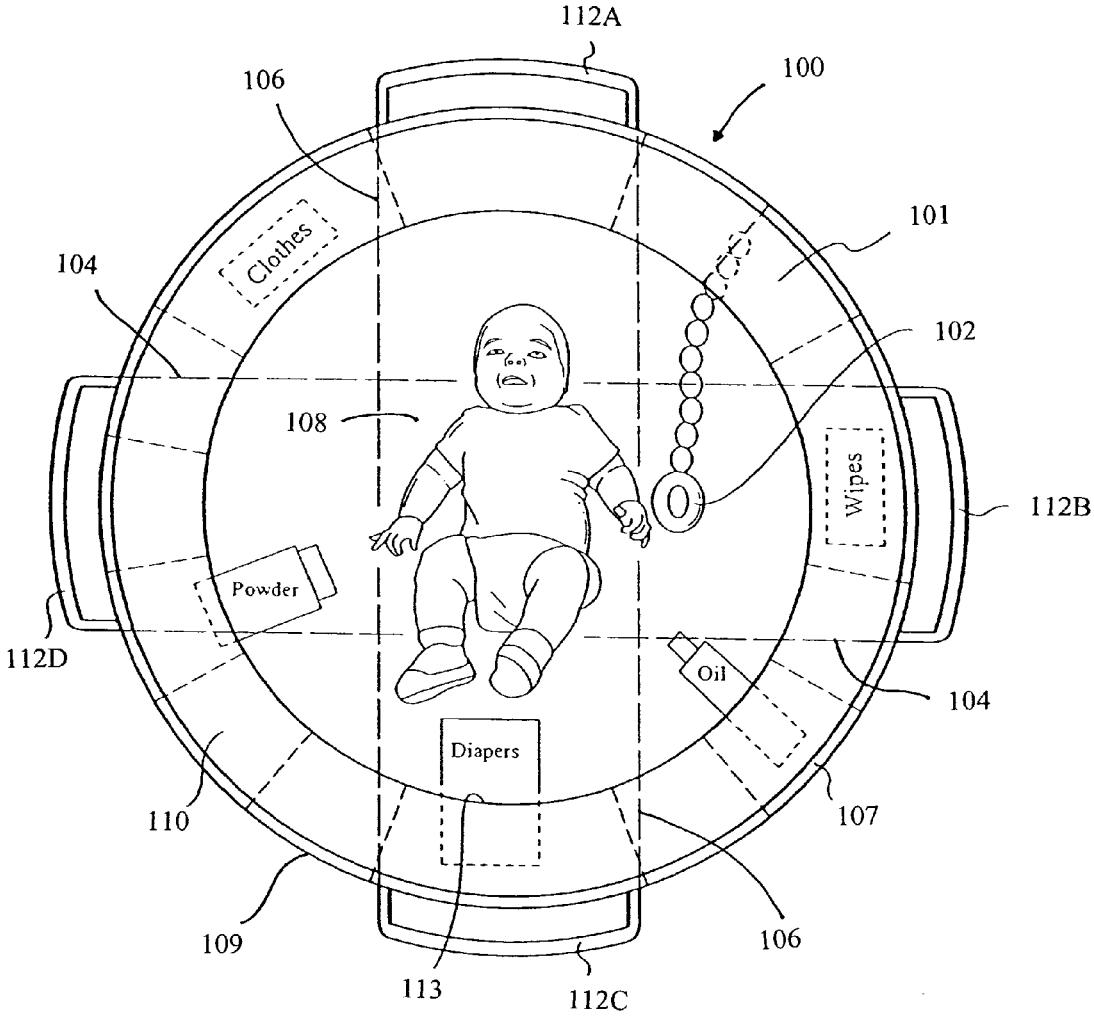
FIG. 2 illustrates a top view of one embodiment of the baby changing article in accordance with the present invention.
Figure 3:
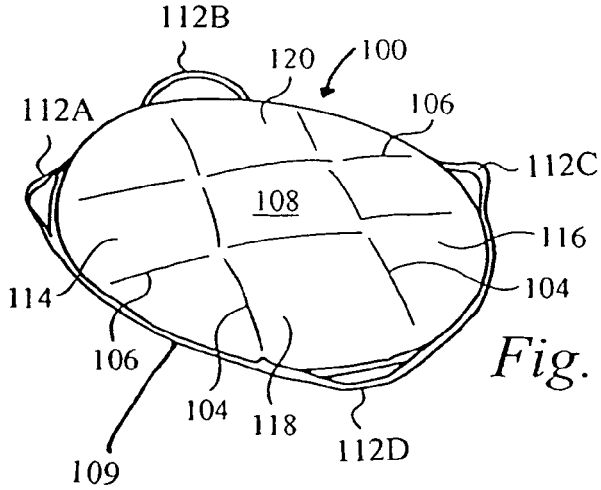
FIGS. 3-10 illustrate one folding procedure of one embodiment of the baby changing article in accordance with the present invention.

FIG. 2 illustrates a top view of one embodiment of the baby changing article 100 in accordance with the present invention. As shown in FIG. 2, the changing article 100 includes a circular storage area 110 radially disposed along the body 101. The storage area 110 is useful for holding objects and supplies (e.g. diapers, powder, toys). In particular, a toy 102 is shown attached to body 101 within the storage area 110 for easy storage when not is use. The storage area 110 is formed by an additional layer of material attached to the outer edge 109 of the body 101, whereby the additional layer is concentrically positioned with respect to the center of the body 101 and has the opening along an inner edge 113 of the storage area 110 as shown in FIG. 2. In another embodiment, at least a portion of the opening of the storage area 110 is located at the outer edge 109 of the body 101, whereby the storage area 110 is attached to the body 101 at the inner edge 113. In one embodiment, the opening of the storage area 110 can be lined with a closing feature [e.g. an elastic material, Velcro® (hook and loop fasteners), zipper] such that objects are prevented from falling out of the storage area 110. In one embodiment, the storage area 110 is partitioned into separate pockets such that objects can be stored in the separate discrete pockets of the storage area 110. In another embodiment, the storage area 110 is not partitioned into separate pockets and is a continuous storage area.

In one embodiment, the changing article 100 has a 30 inch diameter, whereby the fold lines 104 are spaced apart from each other as well as the outer edge 109 of the body 101 by 10 inches. In addition, the fold lines 106 are spaced apart from each other as well as the outer edge 109 of the body 101 by 10 inches. The fold lines 104 and 106 intersect near the center of the body 101 to form a square center portion 108 being 10 inches in length and 10 inches in width. In one embodiment, the changing article 100 includes a concentric storage area 110, whereby the storage area 110 extends inward toward the center from the outer edge by 5 inches.

In another embodiment, the changing article 100 has a 24 inch diameter, whereby the fold lines 104 are spaced apart from each other as well as the outer edge 109 of the body 101 by 8 inches. In addition, the fold lines 106 are spaced apart from each other as well as the outer edge 109 of the body 101 by 8 inches. The fold lines 104 and 106 intersect near the center of the body 101 to form a square center portion 108 being 8 inches in length and 8 inches in width. In one embodiment, the changing article 100 includes a concentric storage area 110, whereby the storage area 110 extends inward toward the center from the outer edge by 4 inches. Alternatively, the storage area 110 extends inward by any other appropriate distance. It should be noted that the changing article 100 alternatively has any other dimensions and is not limited to the dimensions discussed. It is preferred that the fold lines 104, 106 are equally spaced in the body 101, however the fold lines 104, 106 need not be equally spaced.

The changing article 100 is preferably made of vinyl, although plastic-covered cloth is also contemplated. In other embodiments, the changing article 100 is made of other materials, including, but not limited to, nylon, cotton, fleece and canvas. It is apparent that any other appropriate material is contemplated. The material of the changing article 100 should be such that the material can be easily wiped clean. Alternatively, the changing article 100 can be manufactured to be disposable, whereby the material of the changing article 100 can be made of paper or other readily disposable material. The changing article 100 is preferably constructed by forming two pieces of cloth or other material to have the same circular design. The two circular pieces are then preferably sewn to one another along the circular outer edge to form the body 101, whereby preferably a folded braid 107 is sewn to the outer edge. In one embodiment, a padding material (e.g. foam) is placed in between the two circular pieces, although the padding can be omitted. Alternatively, only one piece of cloth is utilized to form the body 101. Following, fold lines 104, 106 are formed into the body 101 in the arrangement described above, whereby the fold lines 104, 106 are preferably sewn into the body 101.

The handles 112A-112D are also preferably attached to the outer edge 109 of the circular body 101, whereby the handles are positioned ninety degrees from each other with respect to the center of the body 101. In one embodiment, the storage area 110 is attached to the body 101 by sewing the outer edge 109 of the storage area 110 to the outer edge 109 of the circular body 101, such that the opening of the storage area 110 faces inward toward the center of the body 101. In addition, it is contemplated in the one embodiment to form individual pockets of the storage area 110. Alternatively, at least a portion of the inner edge of the storage area 110 is attached to the body 101 to form the opening to be at the outer edge 109 of the body 101 (e.g. folded braid). The handles 112A-112D are preferably made of a cloth material. In one embodiment, the handles 112A-112D are made of a material which is slightly elastic to easily secure any of the handles 112A-112D around the square shape folded body 108. It should be noted that the handles 112A-112D are preferably of a length which does not pose a hazard to the child.

Figure 4:
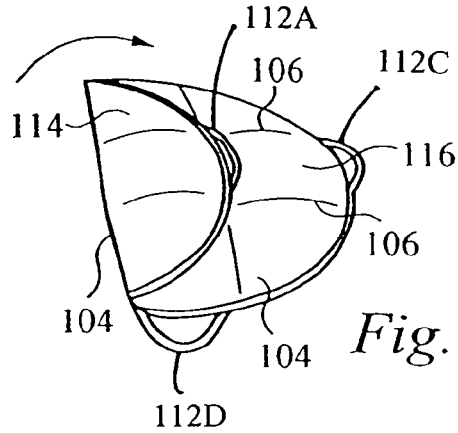
Figure 5:
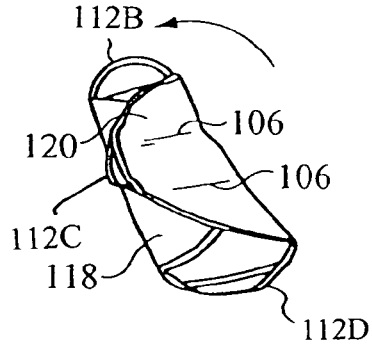
Figure 6:
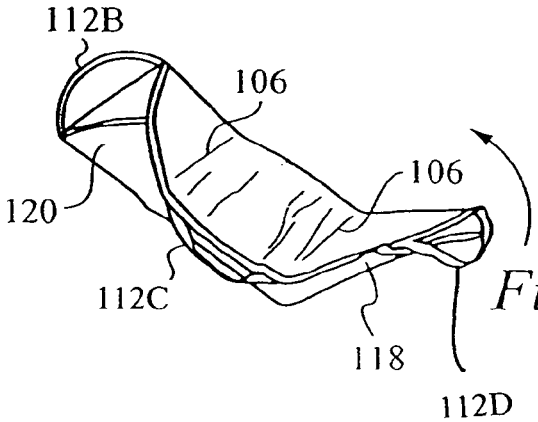
Figure 7:
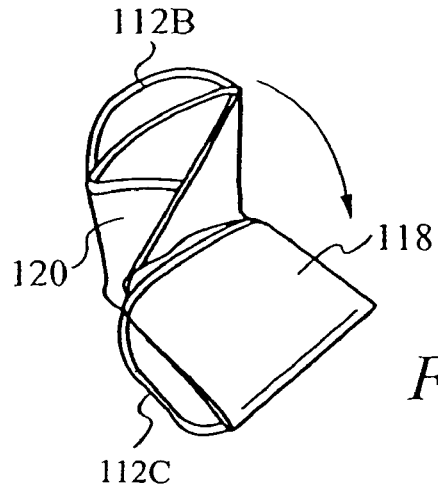
Figure 8:
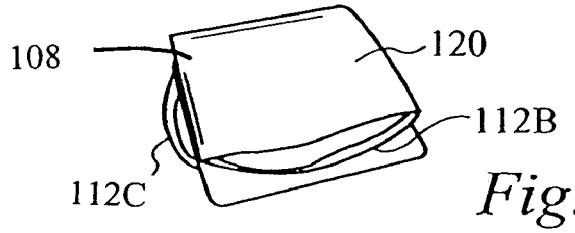

FIGS. 3-10 illustrate one folding procedure of one embodiment of the baby changing article in accordance with the present invention. The changing article 100 is shown laid substantially flat on a surface in FIG. 3. To close the changing article 100 into a closed position, the user folds flap 114 inward toward the center of the body 101 about the fold line 104 as shown in FIG. 4. The user then folds the opposite flap 116 inward toward the center of the body 101 about the fold line 104, as shown in FIG. 5. The user then folds flap 118 inward toward the center of the body 101 about the fold line 106, as shown in FIG. 6. The user then folds flap 120 inward toward the center of the body 101 over the folded flap 118 about the fold line 106, as shown in FIG. 7, to completely fold the changing article into the folded position, as shown in FIG. 8. This forms a square shaped folded body 108, as shown in FIG. 8.

Figure 9:
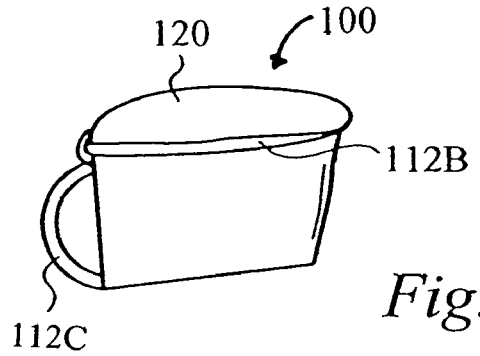
Figure 10:
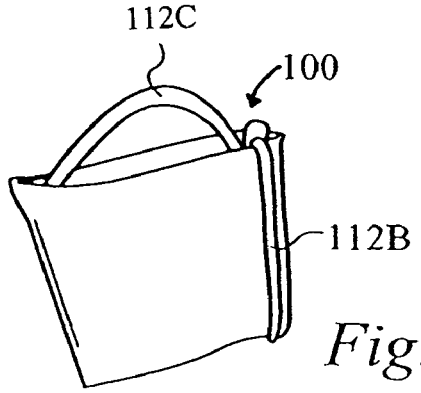

As stated above and shown in FIG. 8, the handles 112A-112D are preferably positioned such that one handle 112B is able to secure the article 100 in the closed position, and another handle 112C is exposed to allow the user to carry the article 100 in the closed, folded position. The handle 112B secures the article 100 closed, whereby the handle 112B is secured around the square center portion 108 of the folded body 101 as shown in FIG. 9. In particular, as shown in FIG. 9, the handle 112B traverses from a first side of the square folded body to the opposite side of the square folded body 108, as shown in FIG. 9. Once the article 100 is in its folded closed carrier position, the user is able to carry the article 100 using the other exposed handle 112C, as shown in FIG. 10. The remaining two handles 112A-112D are preferably hidden within the folded article 100. It is contemplated that the article 100 is opened by reversing the order by which the article 100 is closed.

Alternatively, the article 100 is secured in its closed, carrier position by any other means [e.g. Velcro® (hook and loop fasteners), button]. It should also be noted that the steps described above for folding the article 100 comprise only one method of closing the article, and any other appropriate method of opening and closing the article 100 is contemplated. For example only, the article 100 is closed by first folding the flap 114 about fold line 104; then folding the adjacent flap 118 about fold line 106; folding the following flap 116 about fold line 104; and then folding flap 120 about the fold line 106. Thus, the article 100 is able to be opened or closed securely and also able to be easily carried with one hand, irrespective of the order in which the article 100 is folded. In addition, the article 100 when folded is substantially flat so that the folded article 100 is able to be easily placed in a small enclosed space (e.g. purse, diaper bag).

Figure 11A:
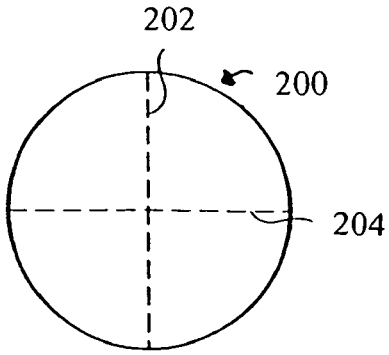
FIGS. 11A, 11B, 12A, 12B, 13A, 13B and 14 illustrate different folding procedures of embodiments of the baby changing article in accordance with the present invention.
Figure 11B:
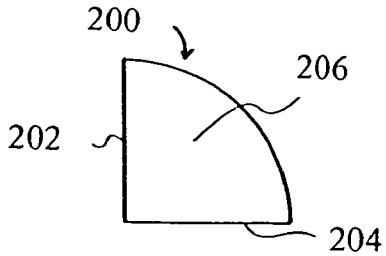
Figure 12A:
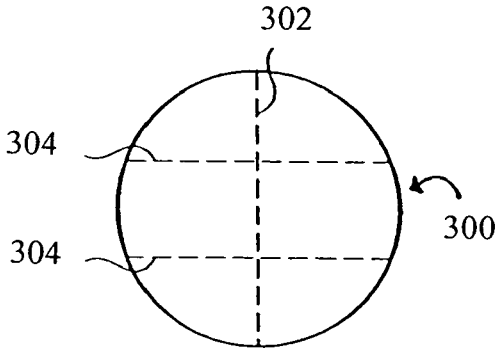
Figure 12B:
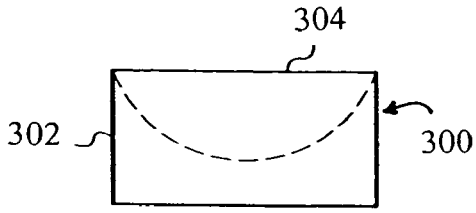
Figure 13A:
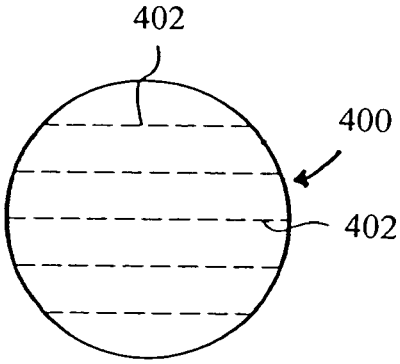
Figure 13B:
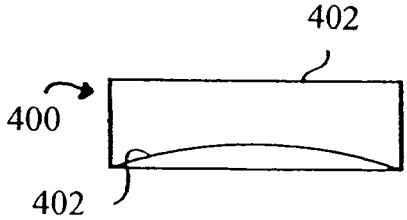
Figure 14:
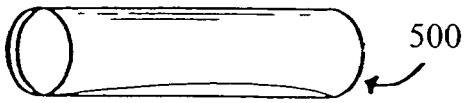

Although the fold lines shown and described in the Figures above are preferred, the article is folded in any other alternative manner. For instance, FIGS. 11A,11B, 12A, 12B, 13A, 13B and 14 illustrate different embodiments of the present changing article having various folding features. For instance, in FIGS. 11A and 11B, the article 200 has folding lines 202, 204 perpendicular to one another through the center of the article 200, whereby the article 200 is foldable into a quarter section 206, as shown in FIG. 11B. In FIGS. 12A and 12B, the article 300 includes one folding line 302 that is a diameter of the circular body, and intersecting lines 304 perpendicular to folding line 302 and two folding lines 304 disposed above and below the center of the body. The circular article 300 is able to be folded about fold lines 302 and 304 into the rectangular folded position, as shown in FIG. 12B. In FIGS. 13A and 13B, the article 400 includes several fold lines 402 disposed parallel to one another. The article 400 is able to be folded into the rectangular folded position, as in FIG. 13B, by folding the article about fold lines 402. In another embodiment, the article 500 is able to be rolled into a rolled-up position, as shown in FIG. 14.

It should also be noted that the article 100 alternatively includes toys or different textured surfaces on or attached to the body 101. For instance, the article 100 can include a toy which is attached to one end of a string, whereby the other end of the string is attached to an inner surface of the storage area 110. Thus, the toy can be easily stored in the storage area 100 when the article 100 is not in use.

The foregoing description of preferred and alternative embodiments of the present invention has been provided for the purposes of illustration and description. It is not intended to be exhaustive or to limit the invention to the precise forms disclosed. Many modifications and variations will be apparent to one of ordinary skill in the relevant arts. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the claims and their equivalence.

What is claimed is:

1. A baby changing article comprising:

a substantially circular body including an outer edge, an upper surface, a lower surface, and a central portion;

a plurality of fold lines within said body to enable said body to be folded for storage, said plurality of fold lines being adapted to facilitate folding and unfolding of said body along said plurality of fold lines between a folded closed configuration and an open unfolded configuration, wherein the folded closed configuration comprises a substantially flat polygonal shape, and wherein said plurality of fold lines includes a first pair of spaced-apart fold lines extending in one direction along said body and towards and terminating at said outer edge, and a second pair of fold lines extending along said body substantially perpendicular to said first pair of fold lines and towards and terminating at said outer edge;

four handles connected to and spaced along said outer edge at approximately 90° from one another, each of said four handles being attached, respectively, to said outer edge at locations where said first pair and said second pair of fold lines extend to said outer edge, the four handles including a first handle, a second handle, a third handle and a fourth handle, the first handle being adapted to maintain said body in the folded closed configuration, the second handle being adapted for a user to carry said body in the folded closed configuration, and the third and fourth handles being exposed in the open unfolded configuration and concealed within said body in the folded closed configuration; and at least one storage area, each at least one storage area concentrically positioned with respect to the center of the body on said upper surface of said body, each at least one storage area abutting the outer edge and having at least one opening toward said central portion of said body.

2. A baby changing article according to claim 1, wherein said first pair of fold lines and said second pair of fold lines each comprise stitch lines formed in said body.

3. A baby changing article according to claim 2, wherein said fold lines of said first pair of fold lines are spaced-apart from one another, said fold lines of said second pair of fold lines are spaced-apart from one another, and the spacing between said fold lines of said first pair and the spacing between said fold lines of said second pair are substantially equal.

4. A baby changing article according to claim 3, wherein said first pair of spaced-apart fold lines and said second pair of spaced-apart fold lines form a square at said central portion of said body.

5. A baby changing article according to claim 3, wherein said first handle comprises a shape to wrap said first handle around said body when it is in the folded closed configuration to secure the baby changing article in the folded closed configuration.

6. A baby changing article according to claim 5, wherein said second handle comprises a shape so that said second handle is exposed in the folded closed configuration of said body to enable a user to carry the baby changing article.

7. A baby changing article according to claim 6, wherein said storage area comprises a plurality of storage pockets arranged radially around said body, each of said storage pockets having an opening proximal to said central portion of said body.

8. A baby changing article according to claim 7, wherein said outer edge comprises a folded braid.

9. A baby changing article according to claim 1, wherein said body includes nine sections that substantially overlap each other in said folded closed configuration, each of the nine sections being separated from each other using said plurality of fold lines.

* * * * *